US005860337A

United States Patent [19]

Janssen

[11] Patent Number: 5,860,337

[45] Date of Patent: Jan. 19, 1999

[54] HAND TOOL WITH ANGULAR INTERCHANGEABLE RATCHETING HEADS

[76] Inventor: William J. Janssen, 109 Powell Ave., Rockville Centre, N.Y. 11570

[21] Appl. No.: 25,560

[22] Filed: Feb. 18, 1998

Related U.S. Application Data

[63] Continuation-in-part of Ser. No. 996,851, Dec. 23, 1997.

[51] Int. Cl.[6] ..... B25B 13/46

[52] U.S. Cl. ..... 81/63; 81/177.7; 81/177.2

[58] Field of Search ..... 81/177.1, 177.2, 81/177.6–177.9, 60–63.2

[56] References Cited

U.S. PATENT DOCUMENTS 928,375 7/1909 Frick ..... 81/177.1 X
1,474,404 11/1923 Church ..... 81/177.1 X
1,840,685 1/1932 Witherup ..... 81/177.8
5,331,869 7/1994 Webb ..... 81/177.2 X

FOREIGN PATENT DOCUMENTS 0191913 8/1986 European Pat. Off. ..... 81/177.2

*Primary Examiner*—D. S. Meislin
*Attorney, Agent, or Firm*—Goldstein & Canino

[57] ABSTRACT

A hand tool for acting upon fasteners which are located in constricted areas. The hand tool comprises an elongated shaft having a handle member at one end and fork connector assembly located at the opposite end thereof. A variety of detachable ratcheting heads may be pivotally attached to the fork assembly. Each ratcheting head may be selectively set to allow only clockwise or counter-clockwise rotation thereof for tightening or loosening of fasteners.

2 Claims, 3 Drawing Sheets

HAND TOOL WITH ANGULAR INTERCHANGEABLE RATCHETING HEADS

This application is a continuation-in-part of application Ser. No. 08/996,851 filed on Dec. 23, 1997.

BACKGROUND OF THE INVENTION

The invention relates to a hand tool. More particularly, the invention relates to an angularly adjustable hand tool which employs an angular pivoting system and detachable, interchangeable ratcheting heads, thus permitting fasteners in concealed and constricted locations to be secured or removed therefrom with ease.

Wrenches known heretofore in the art typically comprise an elongated handle having at one or both ends a gripping means which are either integral with the elongated handle or an extension of said handle which is carried by said elongated handle about the longitudinal axis of the fastener which is to be removed or installed. In either case, the device is useless where the fastener is located in an area of limited lateral clearance for the handle about the axis of the fastener, such as in motor vehicle engine compartments where fasteners which must be reached are often located in tight recesses.

When fasteners which are to be removed or installed are located in constricted areas as discussed above, conventional wrenches typically can be positioned upon the fastener to be grasped. However, because the elongated handle extends radially of the fastener and only a limited amount of space is available, said elongated handle is incapable of being swung sufficiently to tighten or loosen the fastener as needed. Accordingly, it is often the case that surrounding components and elements must be removed to obtain proper access to the targeted fastener. This, of course, results in undue and excessive cost. A hand tool is greatly needed which allows the removal or installation of fasteners in tight, constricted areas where present hand tools are incapable of obtaining access.

While various related prior art units are found in the art which may be suitable for the particular purpose employed, or for general use, they would not be as suitable for the purposes of the present invention as disclosed hereafter.

SUMMARY OF THE INVENTION

It is an object of the invention to produce a hand tool which is capable of installing or removing fasteners from constricted areas which are typically inaccessible to conventional hand tools in the art.

It is another object of the invention to provide a hand tool which accepts a variety of angularly adjustable interchangeable ratcheting heads.

It is a further object of the invention to provide a hand tool which is simple in construction and design, and inexpensive to manufacture.

To the accomplishment of the above and related objects the invention may be embodied in the form illustrated in the accompanying drawings. Attention is called to the fact, however, that the drawings are illustrative only. Variations are contemplated as being part of the invention, limited only by the scope of the claims.

BRIEF DESCRIPTION OF THE DRAWINGS

In the drawings, like elements are depicted by like reference numerals. The drawings are briefly described as follows.

ELEMENT NUMBERS USED IN THE DETAILED DESCRIPTION

Figure 1:
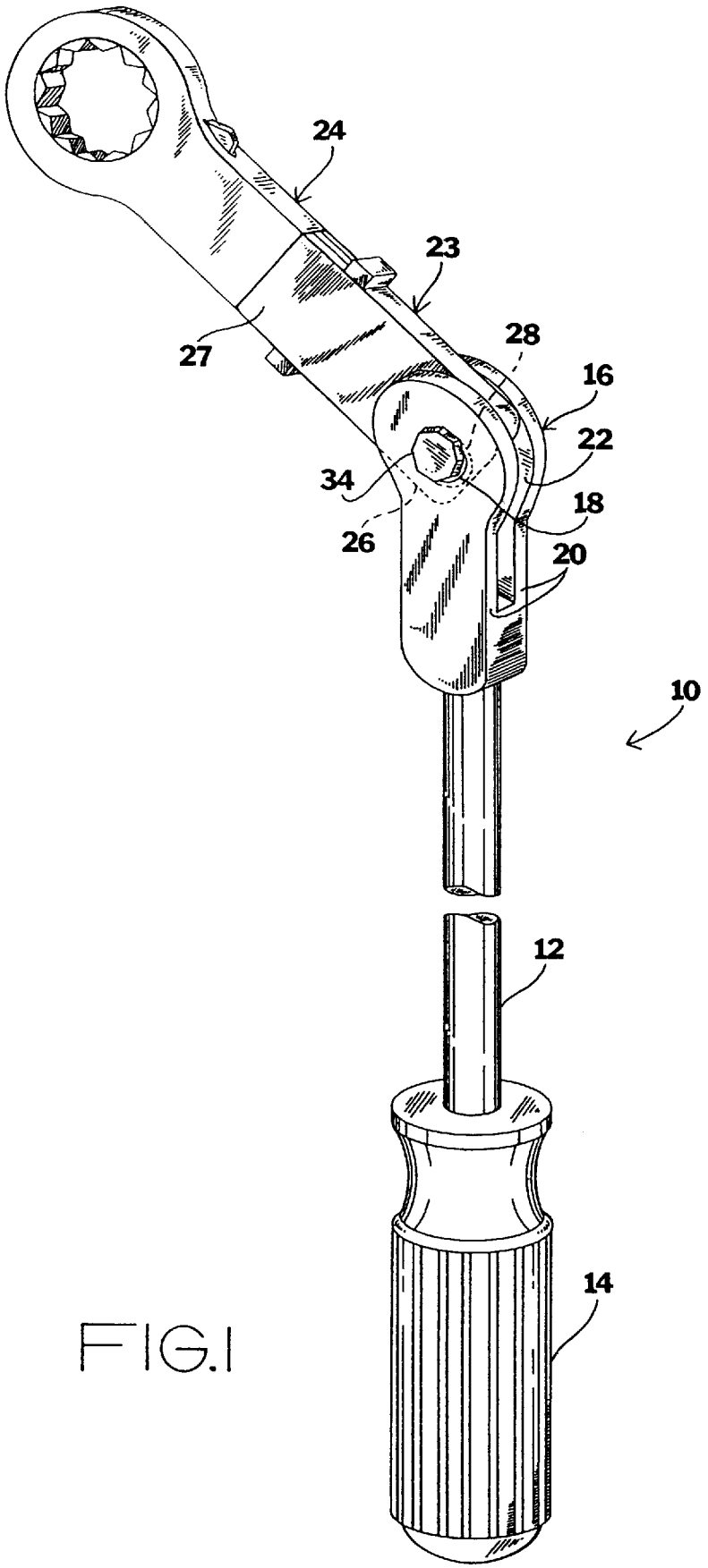
FIG. 1 is a diagrammatic perspective view of the instant invention.

Hand tool 10
Elongated shaft 12
Handle member 14
Forked connector 16
Bore 18
Tines 20
Slotted recess 22
Attachment head neck 23
Hollow interior region 23I
Front face 23F
Rear face 23R
Sidewall 23S
Ratcheting head 24
Bore end 26
Ratchet attachment end 27
Neck bore 28
Open slot 30
Notched fulcrum 32
Button end 32B
Notch end 32N
Pins 34
Button 36
Bayonet 38
Spring 40
Grasping aperture 42
Collar sprocket 44
Teeth 46
Counter-clockwise edge 46W
Clockwise edge 46C
Jam plate 48
Knurled edge 48K
Left barb 50L
Right barb 50R
Resistance edge 51R
Travel edge 51T

DETAILED DESCRIPTION OF THE PREFERRED EMBODIMENTS

Certain terminology is used in the following description for convenience only and is not limiting. The words "right," "left," "lower" and "upper" designate directions in the drawings to which reference is made. The words "inwardly" and "outwardly" refer to directions toward and away from, respectively, the geometric center of the hand tool. The words "proximal end" and "distal end" refer, respectively, to ends of an object nearer to and further from the operator of the object when the object is used in a normal fashion or as is described in the specification.

FIG. 1 illustrates a diagrammatic perspective view of a hand tool 10 of the instant invention. The hand tool 10 comprises an elongated shaft 12 having opposite ends and a handle member 14 located at one of said ends and a forked connector 16 located at the opposite end thereof. The forked connector 16 has a bore 18 extending therethrough as well as a pair of parallel spaced tines 20. The parallel spaced tines 20 define a slotted recess 22 therebetween. An attachment head neck 23 has a bore end 26 and opposite ratchet attachment end 27. The bore end 26 has a neck bore 28 extending therethrough which corresponds in diameter to the bore 18 of the forked connector 16. The attachment head neck 23 is pivotally secured to the forked connector 16 by inserting the bore end 26 into the slotted recess 22 of the forked connector 16 such that the neck bore 28 of said attachment head neck 23 is aligned with the bore 18 of the forked connector 16. A fastener such as a threaded bolt 34 having a correspondingly threaded nut 32 is then inserted through the aligned bores 18 and 28, pivotally securing the bore end 26 of the attachment head neck 23 within the slotted recess 22 of the forked connector 16. Accordingly, the attachment head neck 23 is permitted to extend perpendicular to the elongated shaft 12 as seen in FIG. 1, or to achieve an angle of 180 degrees with respect to the elongated shaft 12, or any angle therebetween in either direction.

Further seen in FIG. 1 is an interchangeable ratcheting head 24 which is removeably secured to the attachment head neck 23 at the ratchet attachment end 27 by means which will be discussed in detail below. Any one of a number of variously sized ratcheting heads 24 may be secured thereto, the ratcheting heads comprising the type commonly referred to as "box-end" in the art and varying in size according to the commonly utilized metric and standard sized fasteners which are most often employed in light and heavy mechanical settings. Regardless of the size of ratcheting head 24 which is employed, the pivotal securement of the attachment head neck 23 to the elongated shaft 12 permits the ratcheting head to achieve an almost infinite number of angles with respect to said elongated shaft 12, thus allowing the ratcheting head 24 access to fasteners which are located in constricted locations.

Figure 2:
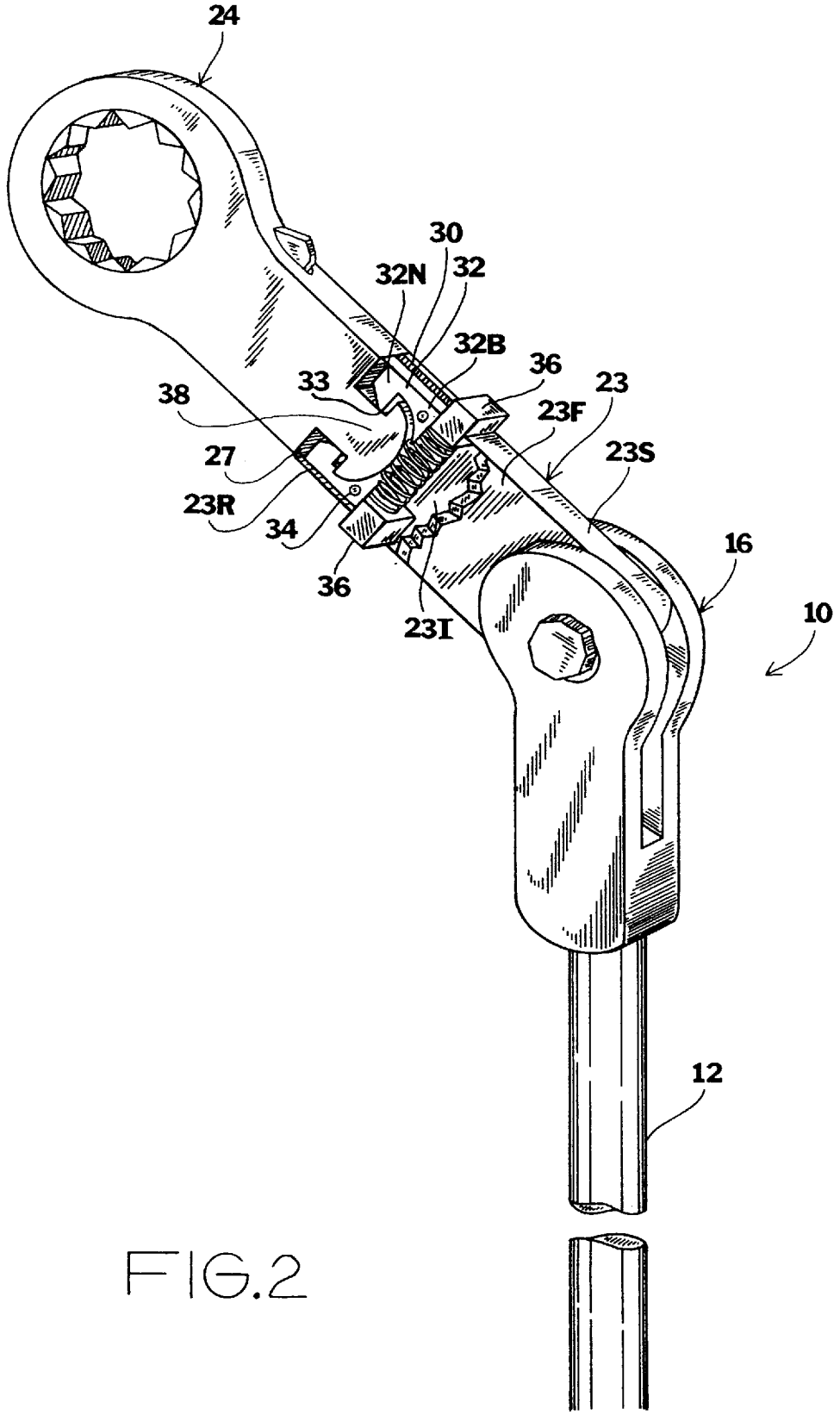
FIG. 2 is an enlarged view of a first interchangeable ratcheting head of the hand tool of the instant invention of FIG. 1.

FIG. 2 illustrates the internal mechanisms of the attachment head neck 23 which permit detachable securement of the ratcheting head 24 thereto. The attachment head neck 23 comprises a front face 23F, a rear face 23R and a pair of side walls 23S all which define a hollow interior region 23I. A pair of notched fulcrums 32 are secured within the hollow interior region 23I by pins 34 which extends from the front face 23R through said notched fulcrums 32 to the rear face 23R, the pins providing a pivot point for the notched fulcrums 32. A button end 32B is located on one side of the pin 34 pivot point, while a notch end 32N is located at the opposite end thereof. The notch end 32N possesses a pawl 33 for reasons which will be discussed below. A button 36 extends outward through each of the side walls 23S and contacts the button end 32B of each notched fulcrum 32, such that when the buttons 36 are depressed, the notch end 32N of the notched fulcrums 32 pivot outward away from each other and protrude through an open slot 30 which extends along the center of each side wall 23S.

The interchangeable ratcheting head 24 has a bayonet 38 extending from an end thereof, the bayonet 38 symmetrically corresponding to the contours of the notch end 32N and pawl 33 of the notched fulcrums 32 so that it may be captured therebetween as seen in FIG. 2 in order to firmly secure the ratcheting head 24 to the ratchet attachment end 27 of the attachment head neck 23. In order to release the ratcheting head therefrom, the buttons 36 are depressed, thus pivoting the notch ends 32N of the notched fulcrums 32 oppositely away from each other and releasing the bayonet 38 from therebetween. It is also contemplated that a resistance spring 40 be biased between the buttons 36 as shown.

Figure 3:
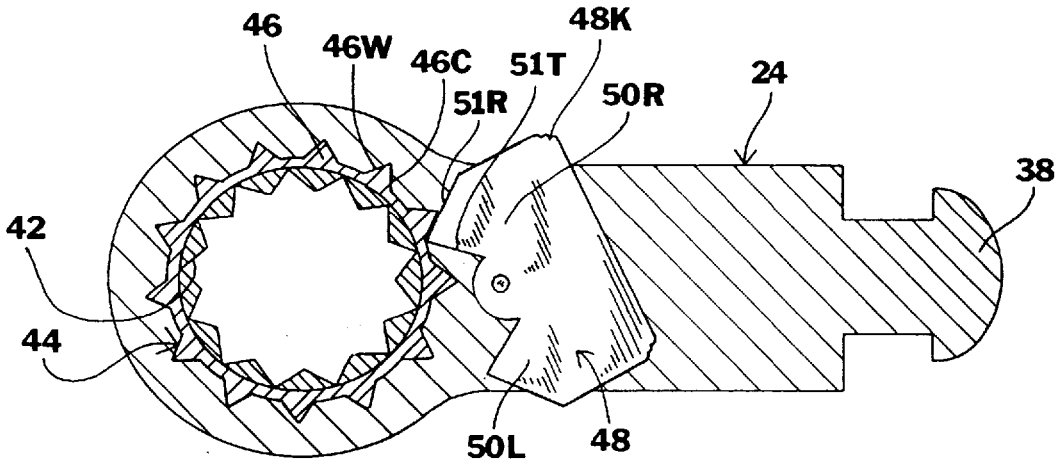
FIGS. 3–4 depicts a cross-sectional view of the interchangeable ratcheting head of the instant invention.

FIG. 3 is a cross section which details the ratcheting mechanisms of the detachable ratcheting head 24. Located opposite from the bayonet 38 is a gripping aperture 42 which is configured to grasp a specifically sized fastener. As mentioned earlier, various sized fasteners can be grasped by interchanging the ratchet heads 24. The grasping aperture 42 is secured to a collar sprocket 44 which is rotateably mounted within the ratcheting head 24. The collar sprocket 44 consists of a plurality of individual sprocket teeth 46, each tooth 46 having a clockwise edge 46C and counter-clockwise edge 46W.

Figure 4:
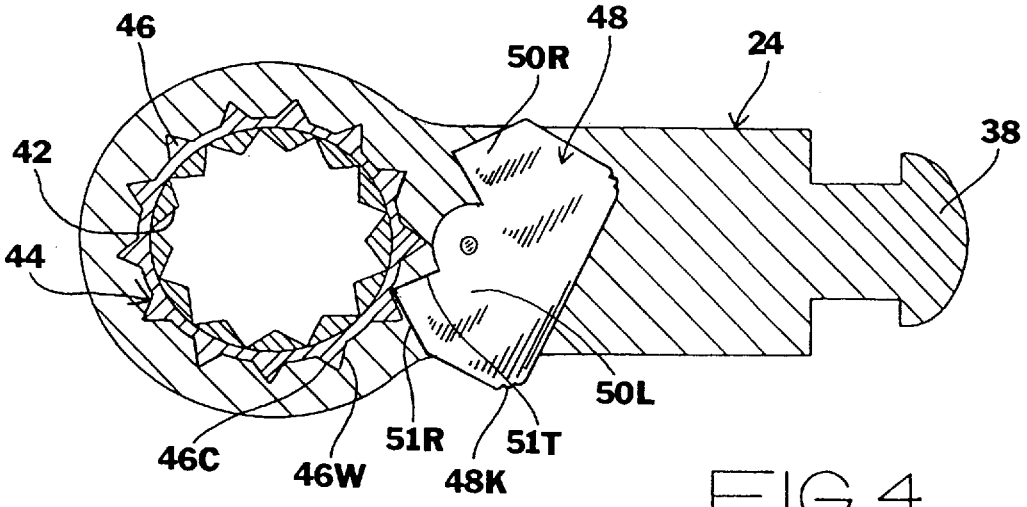

A jam plate 48 is pivotally mounted at it's center point by a pin or the like within the ratcheting head 24. The jam plate 48 consists of a left barb 50L and a right barb 50R. Each barb 50 has a resistance edge 51R and travel edge 51T. Since the jam plate 48 is pivotally mounted to the ratcheting head 24, it is selectively brought from a position where either the left barb 50L or right barb 50R engages the teeth 46 of the collar sprocket 44. When the right barb 50R engages the teeth 46 of the collar sprocket 44, the resistance edge 51R of the right barb 50R abuts the clockwise edge 46C of the tooth 46, while the travel edge 51T of the right barb 50R abuts the counter-clockwise edge 46W of the adjacent tooth 46. Accordingly, the collar sprocket 44 is permitted to travel in a counter-clockwise direction only, as seen in FIG. 3, since the jam plate 48 will be pushed back along it's pivotal rotation axis in response to the counter-clockwise edge 46W of the tooth 46 being forced against the travel edge 51T of the jam plate's 48 right barb 50R. Clockwise rotation will be prohibited as the clockwise edge 46C of the tooth 46 urges against the resistance edge 51R of the right barb 50R of the jam plate 48 since the jam plate 48 is in that instance being pressed against it's pivotal rotation axis. Clockwise rotation can be permitted by engaging the left barb 50L of the jam plate 48 with the teeth 46 of the collar sprocket 44 as is seen clearly in FIG. 4. The jam plate 48 may be selectively brought from the position seen in FIG. 3 to that seen in FIG. 4 by simply sliding the knurled edge 48K of the jam plate 48 forward or rearward as necessary.

What is claimed is:

1. A hand tool for grasping and acting upon a fastener which is located in a constricted area, the hand tool comprising:

a) an elongated shaft having opposite ends;

b) a handle member located at one of the ends of the elongated shaft;

c) a fork connector located at the end of the elongated shaft which is opposite the handle member, said fork connector having a pair of parallel spaced tines which define a slotted recess therebetween and a bore extending through said tines;

d) an attachment head neck having a bore end and opposite ratchet attachment end, the bore end having a neck bore extending therethrough which is inserted into the slotted recess and aligned with the bore of the fork connector tines such that when a fastener is inserted through the aligned bores, the attachment head neck is pivotally secured to the forked connector; the attachment head neck also having a pair of side walls having an open slot which extends along the center thereof, a front face and a rear face which define a hollow interior region, a pair of notched fulcrums secured within the hollow interior region by pins which extends from the front face through said notched fulcrums to the rear face, the pins providing a pivot point for the notched fulcrums, and a button end located on one side of the pin pivot point and a notch end located at the opposite end thereof, the notch end having a pawl, a button extending outward through each of the side which contacts the button end of each notched fulcrum such that when the buttons are depressed the notch end of the notched fulcrums pivot outward away from each other and protrude through the open slot of each sidewall, and the ratcheting head further has a bayonet extending from an end thereof which symmetrically corresponding in shape to the contours of the notch end and pawl of the notched fulcrums so that said bayonet may be captured therebetween in order to firmly secure the ratcheting head to the ratchet attachment end of the attachment head neck until the buttons are depressed thereby releasing the bayonet; and e) an interchangeable ratcheting head having a rotateable grasping aperture for grasping fasteners, the ratcheting head removeably securable to the ratchet attachment end of the attachment head neck; whereby pivotal access may be obtained to fasteners which are located in constricted locations.

2. The hand tool of claim 1, wherein the ratcheting head further comprises a collar sprocket which is secured to the grasping aperture and rotateably mounted within the ratcheting head, the collar sprocket consisting of a plurality of individual sprocket teeth, each sprocket tooth having a clockwise edge and counter-clockwise edge, a jam plate pivotally mounted at it's center point by a pin within the ratcheting head and consisting of a left barb and a right barb, each barb having a resistance edge and travel edge, the jam plate selectively brought from a position where one of said barbs may engages the teeth of the collar sprocket such that when the right barb engages the teeth of the collar sprocket, the resistance edge of the right barb abuts the clockwise edge of the tooth and the travel edge of the right barb abuts the counter-clockwise edge of the adjacent tooth whereby the collar sprocket is permitted to travel in a counter-clockwise direction only since the jam plate will be pushed back along it's pivotal rotation axis in response to the counter-clockwise edge of the tooth being forced against the travel edge of the jam plate's right barb, clockwise rotation prohibited as the clockwise edge of the tooth urges against the resistance edge of the right barb of the jam plate since the jam plate is in that instance being pressed against it's pivotal rotation axis, and clockwise rotation is permitted by engaging the opposite left barb of the jam plate with the teeth of the collar sprocket to allow a converse condition.

* * * * *